US010014588B2

(12) United States Patent
Ryoo et al.

(10) Patent No.: US 10,014,588 B2
(45) Date of Patent: Jul. 3, 2018

(54) NEAR-FIELD ANTENNA APPARATUS USING EDDY CURRENT AND ELECTRONIC DEVICE INCLUDING THE SAME

(71) Applicant: SAMSUNG ELECTRO-MECHANICS CO., LTD., Suwon-si (KR)

(72) Inventors: Jeong Ki Ryoo, Suwon-si (KR); Ju Hyoung Park, Suwon-si (KR); Hyeon Gil Nam, Suwon-si (KR); Jong Lae Kim, Suwon-si (KR); Dae Seong Jeon, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 176 days.

(21) Appl. No.: 14/955,764

(22) Filed: Dec. 1, 2015

(65) Prior Publication Data

US 2016/0164188 A1 Jun. 9, 2016

(30) Foreign Application Priority Data

Dec. 5, 2014 (KR) ..... 10-2014-0173505
Apr. 22, 2015 (KR) ..... 10-2015-0056485

(51) Int. Cl.
*H01Q 7/08* (2006.01)
*H01Q 1/24* (2006.01)
*H01Q 19/06* (2006.01)

(52) U.S. Cl.
CPC ..... *H01Q 19/06* (2013.01); *H01Q 1/24* (2013.01); *H01Q 7/08* (2013.01)

(58) Field of Classification Search
CPC ..... H01Q 1/2208; H01Q 1/2216; H01Q 1/24; H01Q 1/241; H01Q 1/242; H01Q 1/243; H01Q 1/245; H01Q 7/06; H01Q 7/08
See application file for complete search history.

(56) References Cited

U.S. PATENT DOCUMENTS 8,412,276 B2 * 4/2013 Matsuura ..... H04B 5/0068 343/767
9,391,369 B2 * 7/2016 Miura ..... G06K 7/10316
9,466,871 B2 * 10/2016 Nakano ..... H01Q 1/243
2009/0167498 A1 7/2009 Fukuda et al.
2012/0306714 A1 * 12/2012 Yosui ..... H01Q 1/2208 343/788

(Continued)

FOREIGN PATENT DOCUMENTS

KR 10-2002-0008765 A 1/2002
KR 10-2011-0108663 A 10/2011
KR 10-2013-0018933 A 2/2013

(Continued)

OTHER PUBLICATIONS

Korean Office Action dated Nov. 24, 2015 in counterpart Korean Application No. 10-2015-0056485. (11 pages with English translation).

*Primary Examiner* — Tho G Phan
*Assistant Examiner* — Patrick Holecek
(74) *Attorney, Agent, or Firm* — NSIP Law

(57) ABSTRACT

A near-field antenna apparatus including an antenna element around which a coil is wound configured to create a magnetic field; and a conductive material member, disposed in a path of the magnetic field, configured to generate an eddy current from a magnetic flux in a predetermined region.

14 Claims, 7 Drawing Sheets

(56) References Cited

U.S. PATENT DOCUMENTS

| | | | |
|---|---|---|---|
| 2013/0099994 | A1 | 5/2013 | Yosui |
| 2013/0181876 | A1 | 7/2013 | Miura et al. |

FOREIGN PATENT DOCUMENTS

| | | | |
|---|---|---|---|
| KR | 10-2013-0134726 | A | 12/2013 |
| WO | WO 2007/043626 | A1 | 4/2007 |
| WO | WO 2012/014939 | A1 | 2/2012 |

* cited by examiner

NEAR-FIELD ANTENNA APPARATUS USING EDDY CURRENT AND ELECTRONIC DEVICE INCLUDING THE SAME

CROSS-REFERENCE TO RELATED APPLICATIONS

This application claims the benefit under 35 USC 119(a) of Korean Patent Application Nos. 10-2014-0173505 and 10-2015-0056485 filed on Dec. 5, 2014, and Apr. 22, 2015, respectively, in the Korean Intellectual Property Office, the disclosures of which are incorporated herein by reference for all purposes.

BACKGROUND

1. Field

The following description relates to a near-field antenna apparatus and an electronic device including the same.

2. Description of Related Art

In general, a near-field antenna may perform near-field communication (NFC) and power transmission using a magnetic field. For example, the near-field antenna apparatus may perform radio frequency identification (RFID), NFC, and wireless power transfer (WPT), which are contactless wireless communication schemes.

An existing near-field antenna has a thin planar shape with a loop printed on a flexible printed circuit board (FPCB) thereof, and is attached to a battery or a cover of a mobile phone. To this end, however, an FPCB antenna having a special structure for attachment to the battery is required, and manual operations need to be performed to attach the manufactured FPCB to the vicinity of a battery pack.

In order to overcome these shortcomings, a surface-mounted device type chip antenna may be used instead of the FPCB antenna. An existing chip antenna structured to have a conductive loop with a ferrite core which generates a magnetic field aligned in a Z direction. The existing chip antenna needs to be manufactured in such a manner that a conductive coil, wound around a ferrite core having an H shape, is dense or is overlapped two or three times. Also, in such an antenna, a loss is generated due to a proximity effect of an alternating current (AC) signal corresponding to a low frequency (for example, a few MHz to hundreds of MHz). In order to avoid this problem a thickness in the Z direction is increased. In addition, in order for the existing chip antenna to be applied to mobile equipment (for example, a smartphone, or the like) manufactured to have a structure of a small thin plate, the antenna needs to be deformed. In addition, components applied to the mobile equipment need to be reduced to enhance a degree of freedom in terms of design.

Due to the shortcomings of the Z axis direction chip antenna, an X axis or Y axis chip type antenna forming a magnetic field aligned in an X axis direction or Y axis direction may be used, but the X axis or Y axis directional chip type antenna has a drawback in that strength of a magnetic field in the Z axis direction is low, and thus, a solution thereto is required.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a near-field antenna apparatus using an eddy current, and an electronic device having the same includes: an antenna element around which a coil is wound to input or output magnetic flux in a curl up direction of the coil; and a conductive material member disposed in a path of the magnetic field and generating an eddy current induced by a magnetic flux to a predetermined region.

In another general aspect, near-field antenna apparatus includes an antenna element around which a coil is wound configured to create a magnetic field; and a conductive material member, disposed in a path of the magnetic field, configured to generate an eddy current from a magnetic flux in a predetermined region.

In another general aspect, an electronic device includes an antenna element around which a coil is wound configured to generate a magnetic field; and a conductive material member, disposed in a path of the magnetic field, configured to generate an eddy current and a magnetic flux in a predetermined region.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Figure 1:
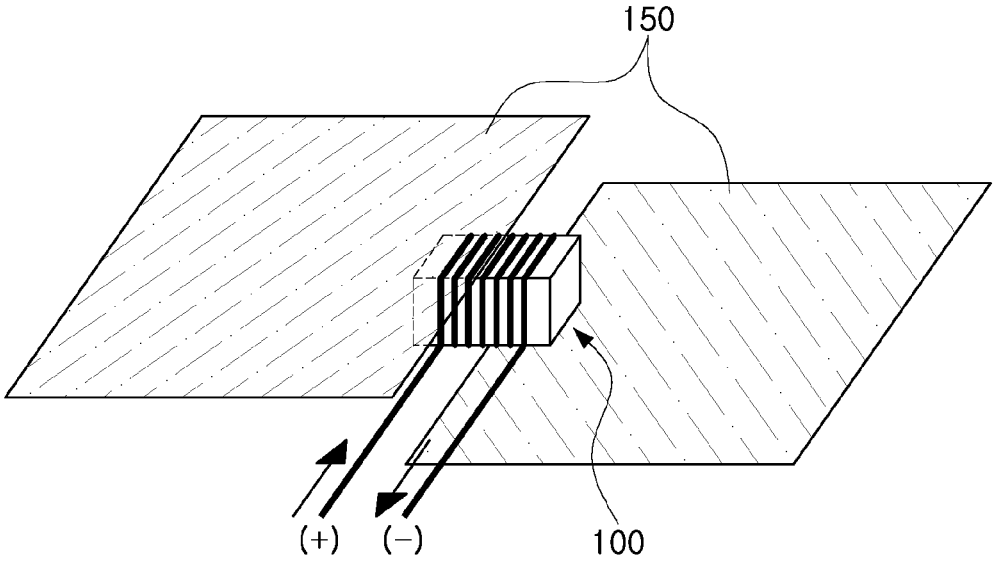
FIG. 1 is a diagram illustrating an example of a near-field antenna apparatus.

Referring to FIG. 1, a near-field antenna apparatus includes an antenna element 100 and a conductive material member 150. The near-field antenna apparatus may be used as a radio frequency identification (RFID), near-field communication (NFC), and wireless power transfer (WPT) antenna based on a contactless wireless communication scheme. A coil is wound around the antenna element 100, and the antenna element 100 receives or generates a magnetic field in a curl up direction of the coil. Here, the curl up direction refers to an axial direction of a circular coil wound around a core. Based on a cylindrical coordinate system, a winding direction of the coil is a direction tangent to the coil or a φ direction, and a Z direction is a direction perpendicular to the axial direction. Thus, the antenna element 100 generates a magnetic field surrounding the antenna element. The magnetic field induces a magnetic flux through the conductive material member 150 in the Z direction.

For example, the antenna element 100 may be a chip antenna formed by winding a coil around a ferrite core. The antenna element 100 may be an X-directed or Y-directed chip type antenna, and is not particularly limited in structure and shape as long as the antenna element 100 is an X-directed or Y-directed chip type antenna. Details of the antenna element 100 will be described in detail with reference to FIGS. 4 and 5.

A magnetic field of the antenna element 100 varies depending on a direction of a current flowing in the coil wound around the antenna element 100 according to Ampere's Law.

The conductive material member 150 is disposed in a path of the magnetic field output from the antenna element 100 inducing an eddy current in a predetermined region of the conductive material 150. Here, the eddy current is induced by a magnetic flux passing through the conductive material member 150, and flows around the magnetic flux. In relation to the cylindrical coordinate system, the magnetic flux passes through the Z direction, and the eddy current flows in a φ direction tangent to the eddy current.

Here, the eddy current flows in such a manner that a magnetic flux is formed in a direction opposite to a direction in which the magnetic field is transmitted. That is, the conductive material member 150 serves as a mirror with respect to the magnetic field. Thus, a target of a magnetic field output from the conductive material member 150 may be adjusted by adjusting a position or a disposition direction of the conductive material member 150. For example, the target may be adjusted to be a predetermined region. A magnetic field toward the conductive material member 150 in the −Z direction creates an eddy current in the conductive material member 150, and this eddy current generates a magnetic field in the +Z direction, thereby increasing the total magnetic field in the +Z direction.

For example, the conductive material member 150 is positioned at one side of an upper portion of the antenna element 100 and/or at the other side of a lower portion of the antenna element 100. That is, the conductive material member 150 may be disposed in an upper portion of a direction in which magnetic field is input in the antenna element 100 (for example a south pole), and in a lower portion of a direction in which magnetic field is output in the antenna element 100 (for example, a north pole). For example, the conductive material member 150 is disposed at diagonal positions of upper and lower surfaces of the antenna element 100 to perform a function of increasing magnetic field formed by the antenna element 100 in the Z axis direction.

For example, the conductive material member 150 may be formed of a conductive material such as a metal able to form an eddy current. The conductive material member 150 may be a printed circuit board (PCB) of a mobile device, a component (a display, a camera, a speaker, a USIM, an earphone jack, etc.) mounted on a PCB, or may be an outer case of a mobile device. Details of implementation of the conductive material member 150 will be described with reference to FIGS. 6A through 7D.

Figure 2:
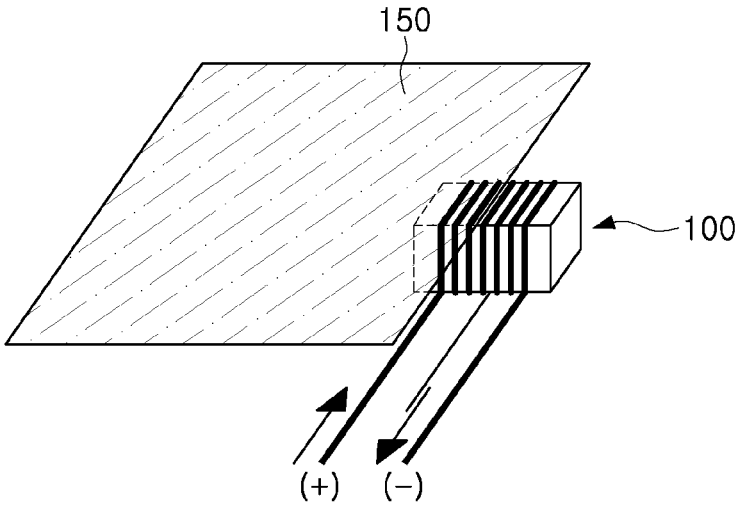
FIG. 2 is a diagram illustrating an example of a near-field antenna apparatus.
Figure 3:
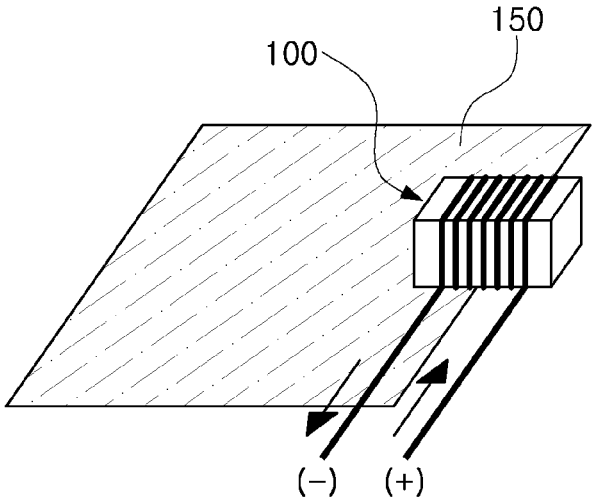
FIG. 3 is a diagram illustrating an example of a near-field antenna apparatus.

Referring to FIGS. 2 and 3, the conductive material member 150 is positioned in any one of the one sides of the upper portion of the antenna apparatus 100 and the other side of the lower portion of the antenna apparatus 100. However, the number of the conductive material members 150 is not limited to two.

As illustrated in FIG. 2, the conductive material member 150 is positioned at one side of an upper portion of the antenna element 100. Thus, a magnetic flux is induced through the conductive material member 150 at a predetermined region based on the magnetic field of the antenna element 100.

As illustrated in FIG. 3, the conductive material member 150 is positioned at the other side of the lower portion of the antenna element 100. Thus, a magnetic flux is induced through the conductive material member at a predetermined region, corresponding to the magnetic field of the antenna element 100. since a direction of the magnetic field of the antenna element 100 or a direction in which a current flowing in the coil wound around the antenna element 100 are opposite to each other, a position of the conductive material member 150 is different. That is, the conductive material member 150 illustrated in FIG. 1 is positioned at a lower portion of the right side, while the conductive material member 150 illustrated in FIG. 3 is positioned at a lower portion of the left side as a magnetic field direction of the antenna element 100 is changed.

The antenna apparatus illustrated in FIGS. 1 through 3 enhances magnetic flux through a conductive material in the Z-axis direction, while maintaining a minimized mounting area having reduced thickness as an advantage of a small antenna.

Figure 4:
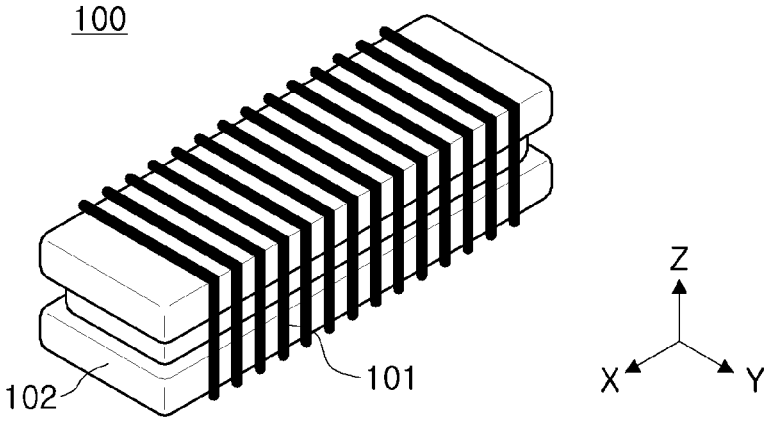
FIG. 4 is a diagram illustrating an example of an antenna element included in the near-field antenna apparatus.

Referring to FIG. 4, the antenna element includes a coil 101 and a ferrite core 102. The antenna element 100 is a small inductively coupled antenna using the coil 101. Also, the antenna element 100 has a significantly reduced size by using the core 102 (such as a ferrite core, or the like). The antenna element 100 inputs or outputs a magnetic field in different directions (+X direction and −X direction) in relation to the center of the chip. Here, a total current of a region spaced apart from the center of the chip in the Z direction may be zero. That is, since the antenna element 100 is substantially symmetrical in the X direction in relation to the center of the chip, a magnitude of magnetic field in the +Z direction and a magnitude of magnetic field in the −Z direction in a region spaced apart from the center of the chip in the Z direction may be substantially the same.

As the conductive material member is disposed in the magnetic field of the antenna element 100, magnetic field around the antenna element becomes asymmetrical in the X direction in relation to the center of chip. Thus, a magnitude of the magnetic field in the +Z direction in a region spaced apart from the center of the chip may be different from a magnitude of magnetic field in the −Z direction. That is, the magnetic flux in the Z axis direction is enhanced.

Hereinafter, examples of a first conductive material member 200 and a second conductive material member 300 will be described.

Figure 5:
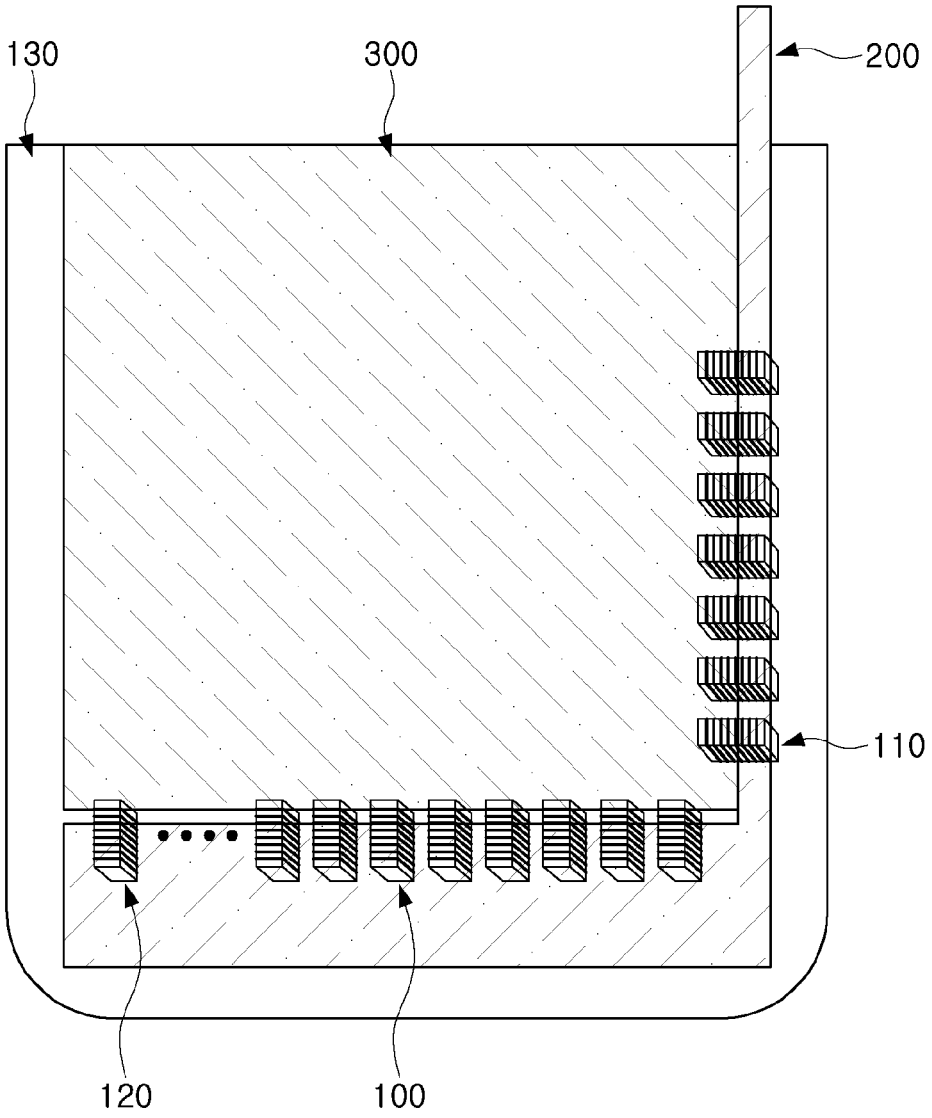
FIG. 5 is a diagram illustrating an example of an implementation of a near-field antenna apparatus with an electronic device.

Referring to FIG. 5, a near-field antenna apparatus includes an antenna element 100, a second antenna element 110, an nth antenna element 120, a first conductive material member 200, and a second conductive material member 300.

A second coil is wound around the second antenna element 110, and thus, the second antenna element 110 has an input or output magnetic field in a curling direction of the winding direction of the second coil. In other words, the antenna element 110 generates a magnetic field which extends from a north pole to a south pole. For example, the second antenna element 110 may input or output magnetic field independently from the antenna element 100. For example, the second antenna element 110 is associated with the antenna element 100 to be configurable as a multi-input multi-output technique.

The second antenna element 110 inputs or outputs magnetic field in a direction perpendicular to a direction in which the antenna element 100 outputs magnetic field. That is, a direction in which the second antenna element outputs a magnetic field, a direction in which the antenna element 100 outputs magnetic field, and a direction in which magnetic flux travels through the conductive material member are perpendicular to each other. Thus, a magnetic field formation region of the antenna apparatus is evenly distributed three-dimensionally.

The nth antenna element 120 is parallel to the antenna element 100 and input or output a magnetic field. For example, a maximum magnitude of the magnetic field output from the antenna device 100 is small, and the antenna apparatus further includes a plurality of nth antenna elements 120 to increase the magnitude of the output magnetic field.

The nth antenna element 120 share the ferrite core with the antenna element 100. That is, a plurality of coils are disposed in the single ferrite core. The first conductive material member 200 is disposed at one side of an upper portion of the antenna element 100 and a magnetic flux travels through the first conductive material member 200 in a first direction. The second conductive material member 300 is disposed at the other side of a lower portion of the antenna element 100 and a second magnetic flux travels through the second conductive material in a second direction.

For example, the first conductive material member 200 and the second conductive material member 300 may cover all the respective paths of the magnetic fields output from the antenna element 100, the second antenna element 110, and the nth antenna element 120. Thus, the area of the first conductive material member and/or the area of the second conductive material member 300 is increased. As the area of the first conductive material member 200 and/or the area of the second conductive material member 300 is increased, an eddy current is formed to be wider and greater. Thus, the magnetic flux in the Z axis direction may be further enhanced. That is, the antenna element 100, the second antenna element 110, and the nth antenna element 120 have a synergistic effect due to the medium of the first conductive material member 200 and the second conductive material member 300.

In the near-field antenna apparatus for use in an electronic device (for example, a smartphone, or the like), the first conductive material member 200 is a printed circuit board (PCB), and the second conductive material member 300 is a metal case supported by a bracket. Here, the electronic device is a device requiring a near-field antenna, without being limited to a specific device.

Figure 6A:
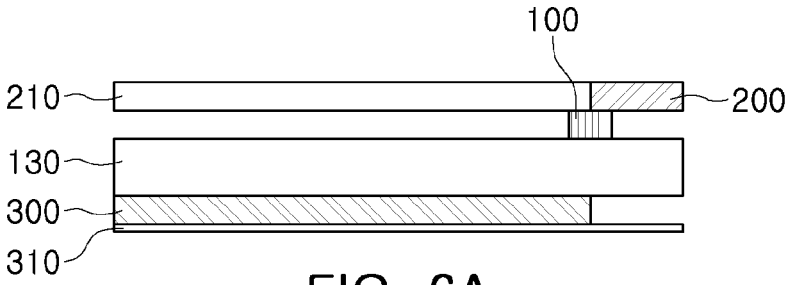
FIGS. 6A and 6B are side views illustrating first and second examples of the electronic device in FIG. 5.

Referring to FIG. 6A, the first conductive material member 200 is a metal surface in the PCB 210, and the second conductive material member 300 is a metal case positioned between a bracket 130 and a display 310.

Figure 6B:
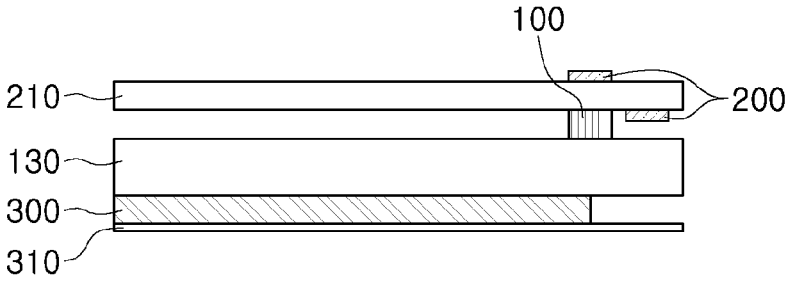

Referring to FIG. 6B, the first conductive material member 200 is a metal surface of a component installed in the PCB 210, and the second conductive material member 300 is a metal case positioned between the bracket 130 and the display 310.

As illustrated in FIGS. 6A and 6B, the antenna element 100 is mounted on the PCB 210. That is, the PCB 210 is configured to output magnetic flux based on the magnetic field of the antenna element 100, as well as providing an installation space of the antenna element 100.

Figure 7A:
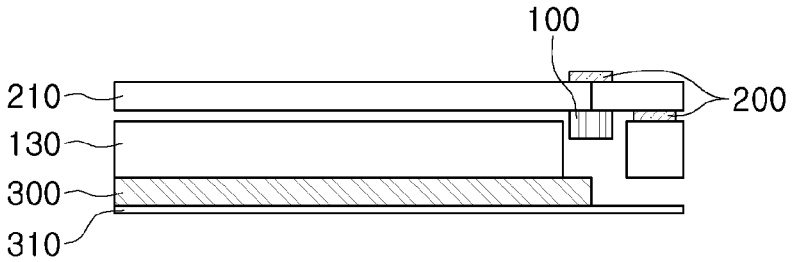
FIGS. 7A through 7D are side views illustrating third, fourth, fifth, and sixth examples of the electronic device in FIG. 5.

Referring to FIG. 7A, the first conductive material member 200 is a metal surface of a component in the PCB 210, and the second conductive material member 300 is a metal case positioned between the bracket 130 and the display 310. Here, the antenna element 100 is in-molded in the bracket 130. That is, the antenna element 100 is accommodated in the bracket 130.

Figure 7B:
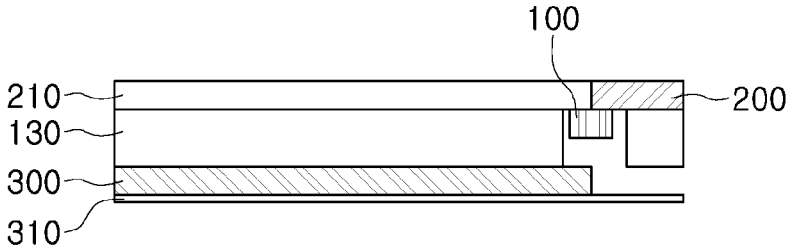

Referring to FIG. 7B, the first conductive material member 200 is a metal surface of a component in the PCB 210, and the second conductive material member 300 is a metal case positioned between the bracket 130 and the display 310. Here, the antenna element 100 is in-molded in the bracket 130. That is, the bracket 130 is molded around and accommodates the antenna element 100.

Figure 7C:
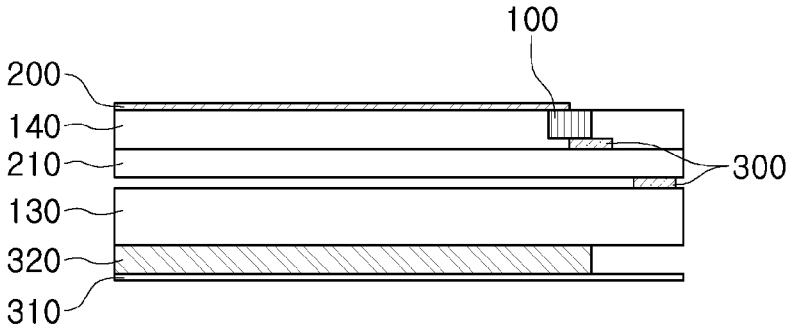

Referring to FIG. 7C, the first conductive material member 200 is a metal surface of a back cover, and the second conductive material member 300 is a metal surface of a component installed in the PCB 210 positioned between the bracket 130 and a rear case 140. Here, the antenna element 100 is in-molded in the rear case 140. That is, the antenna element 100 is accommodated in the rear case 140 upon molding of the rear case. A metal case 320 is positioned between the bracket 130 and the display 310.

Figure 7D:
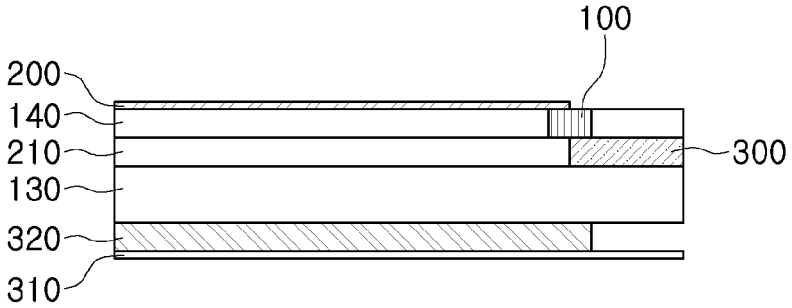

Referring to FIG. 7D, the first conductive material member 200 is a metal surface of a back cover, and the second conductive material member 300 is a metal surface of a component in the PCB 210 positioned between the bracket 130 and a rear case 140. Here, the antenna element 100 is in-molded in the rear case 140. That is, the rear case 140 is molded around and accommodates the antenna element 100. A metal case 320 is positioned between the bracket 130 and the display 310.

As the first and second conductive material members 200 and 300, various metal surfaces, distributed spatially in the vicinity thereof, may be utilized as described above with reference to FIGS. 6A through 7D.

Figure 8:
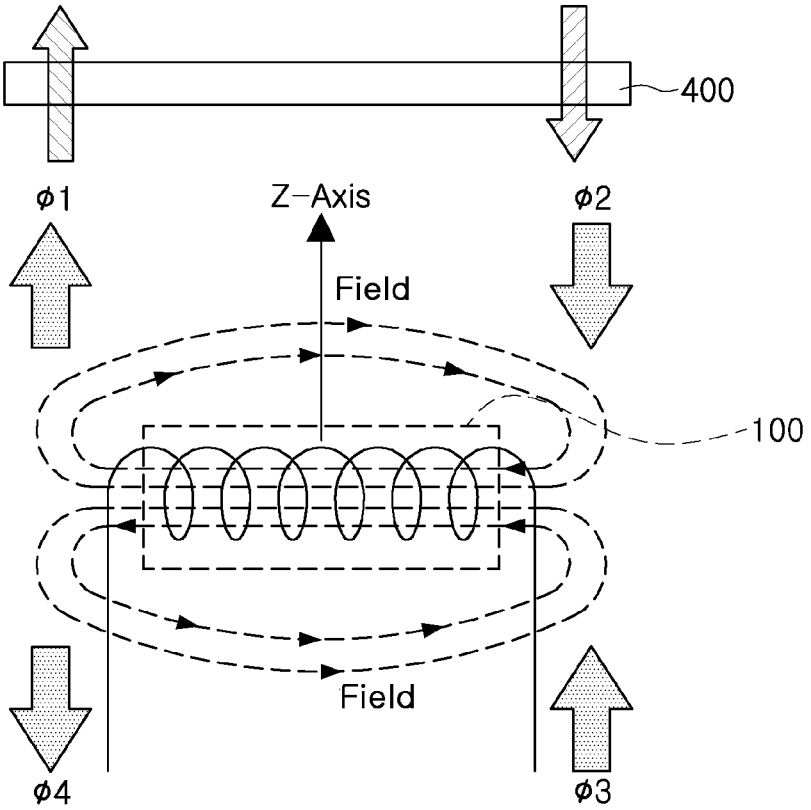
FIG. 8 Related Art
FIG. 8 is a diagram illustrating an example of an existing antenna when a conductive material is absent, and magnetic flux distribution.
Figure 9:
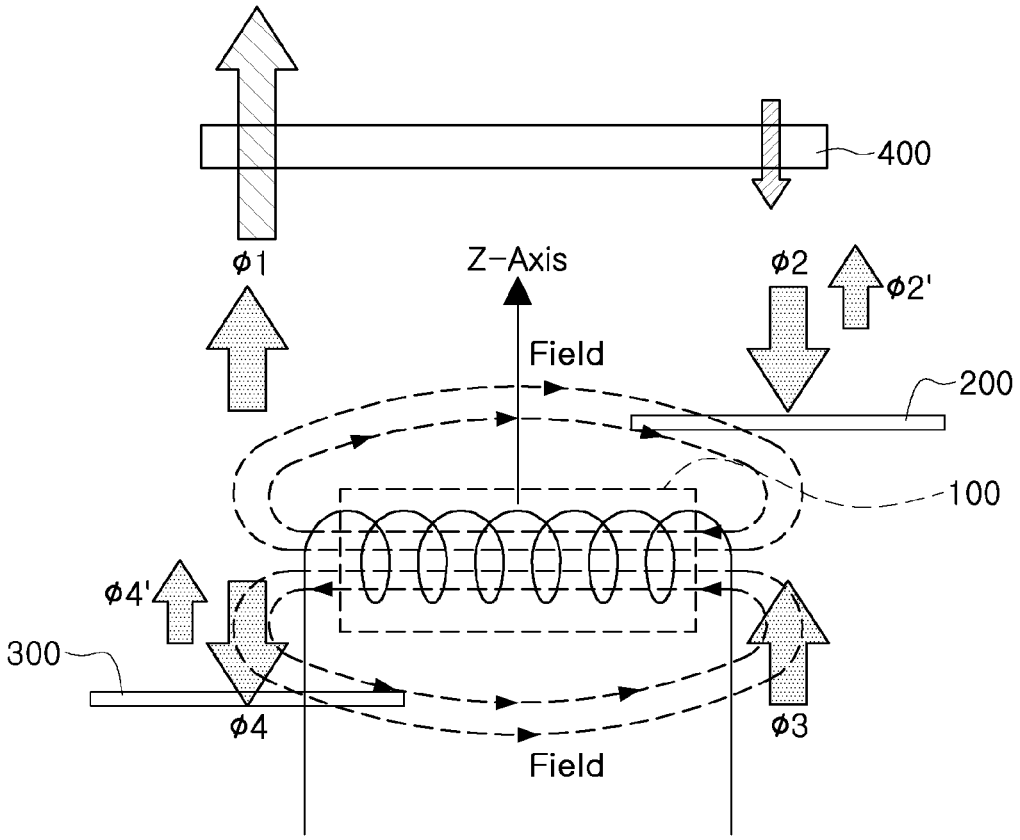
FIG. 9 is a diagram illustrating an example of a near-field antenna apparatus using conductive materials, and magnetic flux distribution.

FIG. 8 is a view illustrating a structure of an existing antenna when a conductive material is absent, and magnetic flux distribution, and FIG. 9 is a view illustrating a structure of a near-field antenna apparatus using two or more conductive materials, and magnetic flux distribution.

Referring to FIG. 9, the near-field antenna apparatus using two or more conductive materials, a magnetic field in the Z-axis direction is increased as compared to the antenna of FIG. 8.

Also, referring to FIGS. 8 and 9, a secondary coil 400 is positioned in a region spaced apart from the antenna apparatus 100 in the Z direction. In the secondary coil 400, a current is induced by the magnetic field output by the antenna apparatus 100, the first conductive material member 200, and the second conductive material member 300. In other words, an area of the secondary coil 400, in which a current equal to or greater than a target value is induced, is increased.

In a case in which the conductive material member is applied, the magnitude of the magnetic field is increased, and a direction of the magnetic field in the Z-axis direction is uniformly maintained, as compared to a case in which only a single chip antenna is applied as in the related art. The magnitude of the magnetic field in the +Z direction is increased in an upper conductive material area.

Since the conductive material member is disposed in the magnetic field path of the antenna element, the magnetic field around the antenna element is asymmetrical in the X direction in relation to the center of the chip. Thus, a magnitude of magnetic field in the +Z direction is different from a magnitude of the magnetic field in the −Z direction in a region spaced apart from the center of the chip in the Z direction. That is, the magnetic field in the Z axis direction is enhanced.

TABLE 1

| Coil size | Z-Axis distance when H = 1.5 A/m |
|---|---|
| 8 × 4 × 1 mm | 23.9 mm |
| 8 × 4 × 1 mm with 40 × 20 mm and 20 × 14 mm Conductive Material Members | 35.4 mm |

Table 1 shows a distance in the Z-axis direction when it is assumed that a magnetic field (H) in the Z-axis direction is uniform, in which it can be seen that the magnetic field extends farther by about 10 mm when an asymmetrical conductive material member is present. As set forth above, magnetic flux in the Z-axis direction is enhanced, while maintaining a minimized mounting area having reduced thickness as an advantage of a small antenna. Also, the antenna apparatus integrally outputs magnetic fields in the Z direction resulting from magnetic fields output from each of a plurality of antenna elements by utilizing various metals distributed spatially in the vicinity thereof. In addition, the electronic device outputs magnetic field with respect to X-axis, Y-axis, and Z-axis directions.

As a non-exhaustive example only, a device as described herein may be a mobile device, such as a cellular phone, a smart phone, a wearable smart device (such as a ring, a watch, a pair of glasses, a bracelet, an ankle bracelet, a belt, a necklace, an earring, a headband, a helmet, or a device embedded in clothing), a portable personal computer (PC) (such as a laptop, a notebook, a subnotebook, a netbook, or an ultra-mobile PC (UMPC), a tablet PC (tablet), a phablet, a personal digital assistant (PDA), a digital camera, a portable game console, an MP3 player, a portable/personal multimedia player (PMP), a handheld e-book, a global positioning system (GPS) navigation device, or a sensor, or a stationary device, such as a desktop PC, a high-definition television (HDTV), a DVD player, a Blu-ray player, a set-top box, or a home appliance, or any other mobile or stationary device capable of wireless or network communication. In one example, a wearable device is a device that is designed to be mountable directly on the body of the user, such as a pair of glasses or a bracelet. In another example, a wearable device is any device that is mounted on the body of the user using an attaching device, such as a smart phone or a tablet attached to the arm of a user using an armband, or hung around the neck of the user using a lanyard.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A near-field antenna apparatus comprising:

an antenna element configured to output a magnetic field generated by a coil wound around the antenna element;

a first conductive material member; and a second conductive material member disposed on an opposite side of an axis of the coil from the first conductive material member, wherein each of the first conductive material member and the second conductive material member is substantially parallel to the axis of the coil, disposed in a path of the magnetic field to receive the magnetic field in a first direction, and configured to output, in a second direction, a magnetic field generated by an eddy current induced therein by the magnetic field received in the first direction, and the first conductive material member and the second conductive material member are substantially non-overlapping.

2. The near-field antenna apparatus of claim 1, wherein the antenna element is mounted on a printed circuit board, the first conductive material member is a metal surface of a component mounted on the printed circuit board, and the second conductive material member is a metal case.

3. The near-field antenna apparatus of claim 1, wherein the antenna element is mounted on a printed circuit board, the first conductive material member is a metal surface of a back cover in which the antenna element is disposed, and the second conductive material member is a metal surface in the printed circuit board.

4. The near-field antenna apparatus of claim 1, wherein the first direction in which the magnetic field is received by the first conductive material member and the second conductive material member is perpendicular to a curl up direction of the coil.

5. The near-field antenna apparatus of claim 1, wherein the antenna element is a first antenna element configured to output a first magnetic field generated by a first coil wound around the first antenna element, the near-field antenna apparatus further comprises a second antenna element configured to output a second magnetic field generated by a second coil wound around the second antenna element, and the first conductive material member and the second conductive material member are disposed in a path of the first magnetic field output from the first antenna element and a path of the second magnetic field output from the second antenna element.

6. The near-field antenna apparatus of claim 5, wherein a direction in which the second antenna element outputs the second magnetic field and a direction in which the first antenna element outputs the first magnetic are perpendicular to each other, and to the second direction in which the magnetic field is output from the first conductive material member and the second direction in which the magnetic field is output from the second conductive material member.

7. The near-field antenna apparatus of claim 1, wherein the second direction in which the magnetic field is output from the first conductive material member is the same as the second direction in which the magnetic field is output from the second conductive material member.

8. An electronic device comprising:

an antenna element configured to output a magnetic field generated by a coil wound around the antenna element;

a first conductive material member; and a second conductive material member disposed on an opposite side of an axis of the coil from the first conductive material member, wherein each of the first conductive material member and the second conductive material member is substantially parallel to the axis of the coil, disposed in a path of the magnetic field to receive the magnetic field in a first direction, and configured to output, in a second direction, a magnetic field generated by an eddy current induced therein by the magnetic field received in the first direction, and the first conductive material member and the second conductive material member are substantially non-overlapping.

9. The electronic device of claim 8, further comprising a printed circuit board on which the antenna element is disposed, wherein the first conductive material member is a metal surface of a back cover, and the second conductive material member is a metal surface of a component mounted on the printed circuit board.

10. The electronic device of claim 9, wherein the antenna element is disposed in a rear case between the printed circuit board and the back cover.

11. The electronic device of claim 8, further comprising a printed circuit board on which the antenna element is disposed, wherein the first conductive material member is a metal surface in the printed circuit board, and the second conductive material member is a metal case supporting a display.

12. The electronic device of claim 11, wherein the antenna element is disposed in a bracket disposed between the printed circuit board and the metal case.

13. The electronic device of claim 8, wherein either one or both of the first conductive material member and the second conductive material member is realized by any one or any combination of a battery, a camera module, and a semiconductor package.

14. The electronic device of claim 8, further comprising a secondary coil disposed at a position enabling a current to be induced in the secondary coil by the magnetic field output from the antenna element and the magnetic field output from each of the first conductive material member and the second conductive material member.

* * * * *